US006406750B1

(12) United States Patent
Izaki et al.

(10) Patent No.: US 6,406,750 B1
(45) Date of Patent: Jun. 18, 2002

(54) PROCESS OF FORMING CATALYST NUCLEI ON SUBSTRATE, PROCESS OF ELECTROLESS-PLATING SUBSTRATE, AND MODIFIED ZINC OXIDE FILM

(75) Inventors: Masanobu Izaki, Nara-ken; Hiroshi Hatase, Kadoma; Yoshikazu Saijo, Hirakata, all of (JP)

(73) Assignees: Osaka Municipal Government; Matsushita Electric Industrial Co., Ltd.; C. Uyemura & Co., Ltd., all of Osaka (JP)

( * ) Notice: Subject to any disclaimer, the term of this patent is extended or adjusted under 35 U.S.C. 154(b) by 0 days.

(21) Appl. No.: 09/580,557

(22) Filed: May 30, 2000

(30) Foreign Application Priority Data

May 28, 1999 (JP) ..... 11-149651
Jun. 25, 1999 (JP) ..... 11-179823
Jul. 29, 1999 (JP) ..... 11-214658

(51) Int. Cl.[7] ..... B05D 1/18; B05D 3/10; B05D 5/12; B05D 3/02; B05D 1/38

(52) U.S. Cl. ..... 427/304; 427/97; 427/98; 427/123; 427/165; 427/169; 427/305; 427/306; 427/343; 427/376.2; 427/404; 427/437; 427/438; 427/443.1

(58) Field of Search ..... 427/97, 98, 123, 427/165, 169, 304, 305, 306, 343, 376.2, 383.1, 404, 437, 438, 443.1

(56) References Cited

U.S. PATENT DOCUMENTS 3,639,143 A * 2/1972 Lussow et al. ..... 117/54
3,802,907 A * 4/1974 Apfelbach et al. ..... 117/54
3,930,896 A * 1/1976 Takahama et al. ..... 148/6.3
3,932,694 A * 1/1976 Hamaguchi et al. ..... 428/432
4,716,736 A * 1/1988 Schwarz ..... 62/48
4,882,202 A * 11/1989 Holtzman et al. ..... 427/98
5,158,645 A * 10/1992 Covert et al. ..... 156/645
5,304,403 A * 4/1994 Schlesinger et al. ..... 427/437
5,649,346 A * 7/1997 Katsuumi et al. ..... 29/25.35
6,106,689 A * 8/2000 Matsuyama ..... 205/333
6,136,693 A * 10/2000 Chan et al. ..... 438/633

* cited by examiner

*Primary Examiner*—Michael Barr
(74) *Attorney, Agent, or Firm*—Sughrue Mion, PLLC

(57) ABSTRACT

A substrate includes a non-conductive portion to be electroless-plated of a substrate, on the surface of which fine metal catalyst particles composed of silver nuclei and palladium nuclei each having an average particle size of 1 nm or less adhere at a high nuclei density of 2000 nuclei/$\mu m^2$ or more. The metal catalyst particles are produced by sensitizing the non-conductive portion of the substrate by dipping the substrate in a sensitizing solution containing bivalent tin ions, activating the non-conductive portion of the substrate by dipping the substrate in a first activator containing silver ions, and activating the non-conductive portion of the substrate by dipping the substrate in a second activator containing palladium ions.

12 Claims, No Drawings

PROCESS OF FORMING CATALYST NUCLEI ON SUBSTRATE, PROCESS OF ELECTROLESS-PLATING SUBSTRATE, AND MODIFIED ZINC OXIDE FILM

BACKGROUBND OF THE INVENTION

The present invention relates to a substrate having on its surface catalyst nuclei, a process of forming the catalyst nuclei on the substrate, a process of electroless-plating the substrate, a process of producing a modified zinc oxide film, and a modified zinc oxide film, which are useful for formation of transparent semiconductor electrodes on glass sheets, plastic sheets, or films used for liquid crystal displays, touch-panels, or solar cells, formation of Cu circuits on printed wiring boards, and formation of electronic part circuits such as formation of Cu wiring on Si substrates used for VLSIs.

In recent years, along with a reduction in sizes and an increase in performances of portable telephones, portable terminal instruments, and note-type personal computes, the packaging density of electronic part circuits has become higher, and correspondingly such circuits have been required to be electroless-plated with no defect. To effectively electroless-plate circuits on non-conductive substrates, metal palladium (Pd) particles are made to adsorb on the non-conductive substrates before electroless plating.

The conventional Pd catalysts, however, are disadvantageous in that the particle size is large and the density of the catalysts adsorbing on a substrate is low. An electroless plating film, which is formed by making the above Pd catalysts adsorb on a substrate and electroless-plating the substrate, has a problem that an initial precipitation layer has a low nuclei density and contains a large number of defects. Accordingly, it has been expected to develop an electroless plating film with no defect in the initial deposition layer.

On the other hand, since a zinc oxide film has a general property that the resistivity is increased after the film is left in air, it is difficult to practically utilize the zinc oxide film as a transparent conductive film.

SUMMARY OF THE INVENTION

A first object of the present invention is to provide a substrate having on its surface catalyst nuclei, which allows the formation of an electroless plating film including a dense initial precipitation layer with no defect.

A second object of the present invention is to provide a process of forming catalyst nuclei on a substrate, which is capable of forming catalyst nuclei on a non-conductive portion to be electroless-plated of a substrate.

A third object of the present invention is to provide a process of electroless-plating the non-conductive portion of the substrate on which the catalyst nuclei have been formed.

A fourth further object of the present invention is to provide process of producing a modified zinc oxide film which has good optical and electric characteristics and less variation in resistivity and thereby suitably used as a transparent conductive film.

A fifth object of the present invention is to provide the modified zinc oxide film produced by the above modified zinc oxide film production process.

The present inventors have examined to achieve the above objects, and found that fine catalyst particles adsorb on a non-conductive substrate at a high density by sensitizing the substrate by using a sensitizing solution containing stannous ions ($Sn^{2+}$), activating the substrate by using a first activator containing silver ions and a second activator containing palladium ions, and finally activating the substrate by the second activator containing palladium ions, and that an electroless plating film with no effect in its initial precipitation layer is obtained by electroless-plating the non-conductive portion of the substrate on which the fine catalyst particles have been formed.

The present inventors have also found that the surface of a zinc oxide film, which is formed on a non-conductive portion of a substrate by activating the surface of the substrate in accordance with the above catalyst nuclei formation treatment and electroless-plating the non-conductive portion, can be modified by dipping the film in a modifier composed of a water solution containing at least one trivalent metal cation such as $In^{3+}$, $A1^{3+}$, $Ga^{3+}$, $Tb^{3+}$, $Y^{3+}$, $Eu^{3+}$, $Bi^{3+}$, $Ru^{3+}$, $Ce^{3+}$, and $Fe^{3+}$, whereby the surface of the film is covered with the above trivalent metal or the oxide thereof by substitution reaction and adsorption reaction of zinc and the metal, and that when the modified film is heated, the variation rate of the resistivity of the modified film after the modified film is left in an atmosphere with a temperature of 60° C. and a humidity of 90% for 5 to 10 days becomes as very small as 120% or less of the initial resistivity, and thereby the modified zinc oxide film is effective to be used as a transparent electrode of a liquid crystal display or a touch-panel, or a transparent semiconductor for a solar cell or the like. On the basis of the above knowledge, the present invention has been accomplished.

To achieve the first object, according to a first aspect of the present invention, there is provided a substrate having a non-conductive portion to be electroless-plated, on the surface of which metal catalyst particles composed of silver nuclei and palladium nuclei each having an average particle size of 1 nm or less adsorb at a nuclei density of 2000 nuclei/$\mu m^2$ or more;

wherein the metal catalyst particles are produced by sensitizing the non-conductive portion by dipping the substrate in a sensitizing solution containing bivalent tin ions, activating the non-conductive portion by dipping the substrate in a first activator containing silver ions, and activating the non-conductive portion by dipping the substrate in a second activator containing palladium ions.

The average surface roughness of the metal catalyst particles may be in a range of 0.5 nm or less.

The ratio in weight of silver particles to palladium particles may be in a range of 1:10 to 10:1.

To achieve the above second object, according to a process of forming catalyst nuclei on a substrate, comprising the steps of:

preparing a substrate having a non-conductive portion to be electroless-plated;

sensitizing the non-conductive portion by dipping the substrate in a sensitizing solution containing bivalent tin ions;

activating the non-conductive portion by dipping the substrate in a first activator containing silver ions; and activating the non-conductive portion by dipping the substrate in a second activator containing palladium ions;

whereby catalyst particles composed of silver nuclei and palladium nuclei each having an average particle size of 1 nm or less adsorb on the non-conductive portion at a nuclei density of 2000 nuclei/$\mu m^2$ or more.

The sensitizing step and the first activating step using the first activator containing silver ions may be repeated by several times.

To achieve the third object, according to a third aspect of the present invention, there is provided a process of electroless-plating a substrate comprising:

preparing a substrate having a non-conductive portion to be electroless-plated;

sensitizing the non-conductive portion by dipping the substrate in a sensitizing solution containing bivalent tin ions;

activating the non-conductive portion by dipping the substrate in a first activator containing silver ions;

activating the non-conductive portion by dipping the substrate in a second activator containing palladium ions; and electroless-plating the non-conductive portion thus activated by dipping the substrate in an electroless plating solution;

wherein catalyst particles composed of silver nuclei and palladium nuclei each having an average particle size of 1 nm or less, at both the activating steps, adsorb on the non-conductive portion at a nuclei density of 2000 nuclei/$\mu m^2$ or more.

The electroless plating solution may be selected from the group consisting of an electroless nickel plating solution, an electroless copper plating solution, and an electroless zinc oxide plating solution.

The substrate may be a silicon substrate on the surface of which either of a Ta film, a TaN film and a TiN film is formed, and the electroless plating solution be the electroless copper plating solution.

The substrate may be a printed wiring board having a through-hole, a peripheral wall portion of which is taken as the non-conductive portion to be electroless-plated, and the electroless plating solution be the electroless copper plating solution.

The substrate may be a polycrystalline glass substrate, and the electroless plating solution be the electroless nickel plating solution.

The substrate may be a transparent substrate such as crystal, amorphous glass plate, plastic plate or plastic film, and the electroless plating solution be the electroless zinc oxide plating solution.

To achieve the fourth object, according to a fourth aspect of the present invention, there is provided a process of producing a modified zinc oxide film, comprising the steps of;

preparing a transparent substrate having a non-conductive portion to be electroless-plated;

sensitizing the non-conductive portion by dipping the substrate in a sensitizing solution containing bivalent tin ions;

activating the non-conductive portion by dipping the substrate in a first activator containing silver ions;

activating the non-conductive portion by dipping the substrate in a second activator containing palladium ions;

electroless-plating the non-conductive portion thus activated by dipping the substrate in an electroless zinc oxide plating solution, to form a zinc oxide film;

treating the zinc oxide film with a modifier composed of a water solution containing trivalent cations; and heating the zinc oxide film thus treated;

wherein catalyst particles composed of silver nuclei and palladium nuclei each having an average particle size of 1 nm or less, at both the activating steps, adsorb on the non-conductive portion at a nuclei density of 2000 nuclei/$\mu m^2$ or more.

The heating step may be performed at a heating temperature ranging from 150° C. to 700° C.

The heating step may be performed in a heating atmosphere selected from air, a non-oxidizing gas atmosphere, and a mixed gas atmosphere thereof.

To achieve the fifth object, according to a fifth aspect of the present invention, there is provided a modified zinc oxide film which is modified from a zinc oxide film by treating the zinc oxide film with a modifier composed of a water solution containing trivalent cations, and heating the zinc oxide film thus treated, wherein the zinc oxide film is formed by preparing a transparent substrate having a non-conductive portion to be electroless-plated; sensitizing the non-conductive portion by dipping the substrate in a sensitizing solution containing bivalent tin ions; activating the non-conductive portion by dipping the substrate in a first activator containing silver ions; activating the non-conductive portion by dipping the substrate in a second activator containing palladium ions; and electroless-plating the non-conductive portion thus activated by dipping the substrate electroless zinc plating solution, wherein catalyst particles composed of silver nuclei and palladium nuclei each having an average particle size of 1 nm or less, at both the activating steps, adsorb on the non-conductive portion at a nuclei density of 2000 nuclei/$\mu m^2$ or more.

The film may have a thickness of 0.005 $\mu$m or more, an average visual light transmittance of 70% or more, and a resistivity of 0.1 Ωcm or less.

The variation rate of the resistivity of the film after the film is left in an atmosphere with a temperature of 60° C. and a humidity of 90% for 20 days may be 120% or less of the initial resistivity.

DETAILED DESCRIPTION OF THE PREFERRED EMBODIMENT

A process of forming catalyst nuclei on a substrate at a high density according to the present invention includes the steps of sensitizing a substrate having a non-conductive portion to be electroless-plated by using a sensitizing solution containing bivalent tin ions, activating the surface of the substrate by dipping the substrate in a first activator containing silver ions, and activating the surface of the substrate by dipping the substrate in a second an activator containing palladium ions, thereby making metal catalyst particles composed of silver nuclei and palladium nuclei adsorb on the non-conductive portion of the substrate.

The substrate used for the above process should have a non-conductive portion to be electroless-plated over the surface or at a specific area of the surface. Examples of the substrates may include non-conductive materials such as glass, plastic and ceramic materials, composites thereof, and composites of the non-conductive materials and metals.

A process of forming catalyst nuclei on the non-conductive portion of the substrate and electroless-plating it preferably includes:

(1) a cleaning step of cleaning the substrate having the non-conductive portion to be electroless-plated under a conventional degreasing condition;

(2) a surface preparation step of imparting electric charges on the surface of the non-conductive portion by using a conventional surface preparation agent;

(3) a sensitizing step of sensitizing the surface of the non-conductive portion by dipping the substrate in a conventional sensitizing solution containing divalent tin ions ($Sn^{2+}$);

(4) a first catalyst nuclei formation step of activating the surface of the non-conductive portion by using a first activator mainly containing silver ions;

(5) a second catalyst nuclei formation step of activating the surface of the non-conductive portion by using a second activator containing palladium ions; and (6) an electroless plating step of forming an electroless plating film on the non-conductive portion of the substrate.

It should be noted that, in the above method, a substrate rinsing step is inserted between the continuous two steps, and the steps (3) and (4) may be repeated by several times as needed and similarly the steps (4) and (5) may be repeated by several times as needed.

Hereinafter, each of the above steps (1) to (6) will be described in detail.

The surface preparation agent may be configured as a water solution mainly containing a cationic surface active agent or cationic polymer compound in an amount of 1 to 50 g/L. The substrate may be dipped in this surface preparation agent kept at a temperature of 10 to 60° C. for a time of 1 to 10 min.

The sensitizing solution used for the sensitizing treatment may be configured as a water solution containing bivalent tin ions in an amount of 1 to 50 g/L and having a pH of 1 to 3, which is prepared by dissolving a bivalent tin salt such as $SnCl_2$ or $SnSO_4$ in an acidic solution such as hydrochloric acid or sulfuric acid. The substrate to be treated may be dipped in this solution kept at a temperature of 10 to 60° C. for a time of 10 sec to 5 min, preferably, 30 sec to 2 min.

The first activator containing silver ions used at the above step (4) may be configured as a water solution containing silver ions in an amount of 0.0001 to 0.5 mol/L, preferably, 0.001 to 0.1 mol/L.

As a supply source of silver ions, a silver salt such as silver sulfate, silver sulfite, silver nitrate, silver thiosulfate, or silver methanesulfonate may be used but not limited thereto. The activation ability of the activator mainly containing silver ions can be improved by adding bivalent metal ions thereto.

To be more specific, nickel ions, cobalt ions, iron ions, zinc ions, or copper ions may be preferably added to the activator mainly containing silver ions. The concentration range of the additional metal ions may be the same as that of the silver ions, i.e., in an amount of 0.0001 to 0.5 mol/L, preferably, 0.001 to 0.1 mol/L. In addition, sulfate ions, nitrate ions, halogen ions, or methanesulfonate ions may be used, but not limited thereto, as anion ions to the above-described silver ions. The pH of the activator mainly containing silver ions may be in a range of about 5 to 11.

The temperature of the activator mainly containing silver ions according to the present invention can be set in a wide range but may be generally set in a range of 15 to 60° C. The dipping time in the activation treatment using the silver based activator can be suitably selected but may be generally set in a range of 10 sec to 5 min, preferably, 30 sec to 2 min.

The second activator containing palladium (Pd) ions used at the step (5) may be configured as a solution containing bivalent Pd ions in an amount of 0.01 to 1 g/L and having a pH of 1 to 3, which is prepared by dissolving a bivalent Pd salt such as $PdCl_2$ or $PdSO_4$ in an acid solution such as hydrochloric acid or sulfuric acid. The substrate to be treated may be dipped in this solution kept at a temperature of 10 to 60° C. for a time of 1 sec to 5 min, preferably, 1 sec to 1 min. If the substrate is dipped in this solution for an excessively longer time, there may occur aggregation of Pd particles, which may obstruct formation of the initial dense precipitation layer.

The activation ability of the second activator can be improved by adding $Pb(NO_3)_2$, $Ag_2SO_4$ or borofluoric acid to the solution mainly containing Pd ions in a slight amount, preferably, in a range of 0.1 to 100 mg/L.

According to the present invention, the above steps (3) and (4) may be repeated by several times, preferably, two to six times, more preferably, three to four times with the rinsing step put therebetween. With this repetition of the steps (3) and (4), it is possible to certainly form a high dense catalyst layer.

The above steps (4) and (5) may be repeated by two to six times with the rinsing step put therebetween, and particularly from the viewpoint of avoiding aggregation of Pd particles, may be repeated by two to three times with the rinsing step put therebetween.

The electroless plating solution used at the above step (6) may be either of known autocatalytic type electroless plating solutions, for example, an electroless copper plating solution using formaldehyde as a reducing agent; an electroless nickel-phosphorus plating solution using sodium hypophosphite as a reducing agent; an electroless nickel-boron plating solution using dimethylamine-borane as a reducing agent; an electroless palladium plating solution; an electroless palladium-phosphorus plating solution using sodium hypophosphite as a reducing agent; an electroless gold plating solution; electroless silver plating solution; and an electroless nickel-cobalt-phosphorus plating solution using sodium hypophosphite as a reducing agent.

The electroless plating using the above electroless plating solution may be performed under a conventional plating condition corresponding to the kind of the plating solution. The plating thickness is suitably set in accordance with the application of the substrate having been subjected to the electroless plating.

As the electroless plating solution, there also can be used an electroless zinc oxide plating solution capable of depositing zinc oxide (ZnO). Such a plating solution may be configured as a solution containing a zinc salt such as zinc sulfate in an amount of 0.01 to 0.5 mol/L, preferably, 0.05 to 0.2 mol/L, and a borane based reducing agent such as dimethylamine-borane or another reducing agent in an amount of 0.001 to 0.5 mol/L, preferably, 0.01 to 0.2 mol/L, more preferably, 0.03 to 0.1 mol/L, and having a pH of about 4 to 9, preferably, about 6.5. The substrate to be treated may be dipped in this plating solution kept at a temperature of 10 to 80° C. for a time of 5 to 120 min.

As the most preferable electroless zinc oxide plating solution, there can be used a solution containing 0.1 mol/L of $Zn(NO_3)_2$ and 0.03 mol/L of dimethylamine-borane and having a pH of 6.5. A zinc oxide film formed by using such a plating solution is advantageous in that the particle size is small, each crystal is oriented along the C-axis (0001), and the number of voids is reduced, with a result that the transparency and electric conductivity of the film are improved.

According to the present invention, metal catalyst particles of silver and palladium can be made to adsorb, by the above catalyst nuclei formation treatment, on the non-conductive portion to be electroless-plated of the substrate at a nuclei density of 2000 nuclei/$\mu m^2$ or more, preferably, 2000 to 5000 nuclei/$\mu m^2$, particularly, 2500 to 3500 nuclei/$\mu m^2$. In this case, the metal catalyst particle layer formed on the surface of the non-conductive portion at a high density can have an average surface roughness of 0.5 nm or less, preferably, 0.05 to 0.5 nm, particularly, 0.1 to 0.3 nm; and an average catalyst particle size of 2 nm or less, preferably, 0.1 to 2 nm, more preferably, 0.3 to 1 nm. It should be noted that the above nuclei density, average roughness, and average particle size can be measured by AFM (Atomic Force Microscope).

In the metal catalyst particles formed according to the present invention, the weight ratio between silver and palladium may be 1:10 to 10:1 preferably, 1:4 to 3:1, more preferably, 1:3 to 1:1. It should be noted that the ratio between the contents of silver and palladium can be analyzed by ESCA (Electron Spectroscopy for Chemical Analysis).

According to the present invention, fine catalyst particles can be made to adhere on a non-conductive substrate at a high density by treating the substrate using the first activator mainly containing silver and the activator containing palladium, and finally dipping the substrate in the second activator containing Pd ions.

The mechanism for making fine metal particles adhere on the non-conductive portion at a high density is not clear but may be considered as follows: namely, silver ions adsorb on the surface of the substrate at a high density preferably by repeating several times the sensitizing treatment (performed by dipping the substrate in the sensitizing solution containing tin ions) and the activation treatment (performed by dipping the substrate in the first activator containing silver ions), and palladium particles are precipitated on the surface of the substrate, on which the silver ions having adsorbed, by dipping the substrate in the second activator containing palladium ions, whereby fine metal particles made from silver and palladium adhere on the surface of the substrate at a high density by interaction between the silver ions and palladium ions.

According to the electroless plating process using the above-described catalyst nuclei formation treatment, an electroless plating film having the initial dense deposition layer can be formed without occurrence of defect. Such an electroless plating film can be effectively used in the filed of electronic parts, for example, for formation of a printed wiring board and a Cu circuit on a VLSI chip, formation of an Ni—P underlayer for a computer hard desk, and formation of a transparent electrode for a liquid crystal display and a transparent semiconductor electrode for a solar cell.

According to the present invention, fine metal catalyst particles made from silver and palladium can be formed on a non-conductive substrate at a high density.

Incidentally, the above-described zinc oxide film formed by the electroless plating process of the present invention may be subjected to heat-treatment. The heat-treatment may be performed at a temperature of 150 to 700° C., preferably, 200 to 650° C., more preferably, 400 to 600° C. for a time of 5 min to 2 hr, particularly, 10 min to 1 hr. The heating atmosphere may be either of atmospheric air, a non-oxidizing gas atmosphere such as nitrogen, helium or argon, and a mixed gas atmosphere thereof.

With this heat-treatment, the zinc oxide film can exhibit a good transparency, concretely, an average visual light transmittance of 70% or more, particularly, 80% or more, and a good electric conductivity, concretely, a resistivity of 0.1 Ωcm or less, particularly, 0.05 Ωcm or less.

Next, a modified zinc oxide film will be described in detail.

The zinc oxide film formed by the electroless plating process using the catalyst nuclei formation treatment can be modified into a zinc oxide film excellent in optical and electric properties and further in heat resistance and moisture resistance by treating the zinc oxide film with the following modifier and heating the treated film.

The modifier according to the present invention is configured as a water solution containing trivalent metal cations. Specific examples of the trivalent metal cations may include $In^{3+}$, $Al^{3+}$, $Ga^{3+}$, $Tb^{3+}$, $Y^{3+}$, $Eu^{3+}$, $Bi^{3+}$, $Ru^{3+}$, $Ce^{2+}$, $Fe^{3+}$. They are used singly or in combination. As anions to the trivalent metal ions, there may be used, but not exclusively, anions capable of making the trivalent metal ions water-soluble. Specific examples of the anions may include sulfate ions, halogen ions, phosphate ions, nitrate ions, acetate ions, citrate ions, lactate ions, and carboxylate ions. The trivalent metal cations may be contained in a water solution in an amount of 0.1 to 50 g/L, preferably, 0.3 to 10 g/L, more preferably. 0.5 to 5 g/L.

The pH of the trivalent metal cation containing water solution (modifier) may be in a range of 2 to 10, preferably, 3 to 8.

The modifier of the present invention may contain ammonium sulfate in an amount of 0.1 to 5 g/L, preferably, 0.5 to 2 g/L, polyethylene glycol in an amount of 0.01 to 1 g/L, preferably, 0.05 to 0.5 g/L, and L-ascorbic acid in an amount of 0.01 to 1 g/L, preferably, 0.05 to 0.5 g/L.

The treatment condition for treating the zinc oxide film with the modifier of the present invention may be suitably selected and may be generally set such that the treatment temperature is in a range of 10 to 60° C., preferably, 20 to 40° C. and the treatment time is in a range of 1 sec to 10 min, preferably, 5 sec to 5 min. The treatment may be performed by dipping the zinc oxide film in the modifier, or spraying the modifier on the zinc oxide film.

According to the present invention, the modifying treatment is performed by dipping the zinc oxide film in the modifier configured as a water solution containing trivalent metal cations or spraying the water solution on the zinc oxide film. With this treatment, the trivalent metal substitutes for and adsorb on zinc, so that the zinc oxide film is covered with the trivalent metal or the oxide thereof. As a result, a modified zinc oxide film having a good electric conductivity and a resistivity with less variation can be obtained. The reason why the electric conductivity of the zinc oxide film is improved is not clear but may be considered as follows: namely, the concentration of carriers is increased by using a trivalent metal as a donor element to bivalent Zn. The reason why the variation in resistivity of the zinc oxide film becomes smaller is not clear but may be considered as follows: namely, the property inherent to zinc oxide that the resistivity is increased after the zinc oxide is left in air is eliminated by covering the outermost layer of the zinc oxide film with a stable layer made from a material different in property from zinc oxide.

As a result of element analysis of the surface of the modified zinc oxide film obtained by the above-described method by ESCA (Electron Spectroscopy for Chemical Analysis), it was confirmed that the outermost layer of the zinc oxide film is covered with a trivalent metal such as In, Al, Ga, Tb, Y, Eu, Bi, Ru or Ce, or the oxide thereof.

According to the present invention, the zinc oxide film thus modified may be preferably subjected to heat-treatment.

The heat-treatment may be performed at a temperature of 150 to 700° C., preferably, 200 to 650° C., more preferably, 400 to 600° C. for a time of 5 min to 2 hr, particularly, 10 min to 1 hr.

The heating atmosphere may be either of atmospheric air, a non-oxidizing gas atmosphere such as nitrogen, helium or argon, and a mixed gas atmosphere thereof.

With this heat-treatment, the variation rate of the resistivity after the film is left in an atmosphere with a temperature of 60° C. and a humidity of 90% for 5 to 20 days can be reduced to 120% or less of the initial resistivity. Further, the zinc oxide film thus heat-treated can exhibit a good transparency, concretely, an average visual light transmittance of 75% or more, particularly, 80% or more, and a good electric conductivity, concretely, a resistivity of 0.1 Ωcm or less, particularly, 0.05 Ωcm or less. Additionally, the lower limit of the above resistivity is $1\times10^{-2}$ Ωcm or more. Accordingly, the zinc oxide film of the present invention having a good electric conductivity and a good transparency can be effectively used for a transparent electrode of a liquid crystal display or a transparent semiconductor electrode of a solar cell. In addition, the thickness of the zinc oxide film can be set, not limited thereto, in a range of 0.005 μm or more, preferably, 0.01 to 2 μm, particularly, 0.1 to 1 μm.

According to the present invention, by applying the modifier and the modifying method of the present invention to an electroless zinc oxide film formed by electroless plating, a modified zinc oxide film having the above film characteristics can be relatively easily formed on a substrate having a large size and a three-dimensional free curve surface. Further, the modified zinc oxide film can be applied to a large-sized substrate such as a car window glass sheet or an architectural window glass sheet by adjusting the characteristics as needed.

The modified zinc oxide film treated with the modifier of the present invention has a reduced variation in resistivity with elapsed time.

The treatment using the above modifier also can be effectively used for a zinc oxide film formed by electroplating a substrate or the above-described electroless zinc oxide film.

In this case, as an electrolytic solution, any solution can be used so long as it can deposit zinc oxide; although a solution containing a zinc salt such as zinc nitrate in an amount of 0.01 to 0.5 mol/L, preferably, 0.05 to 0.2 mol/L, and having a pH of about 4 to 9, preferably, 6 may be preferably used. The electrolytic solution is electrified by a quantity of 0.1 to 20 coulombs, preferably, 1 to 10 coulombs per 1 $cm^2$ of a conductive substrate by using an anode made from zinc, carbon or platinum. The temperature of the electrolytic solution is kept in a range of 10 to 80° C.

The present invention will be more clearly understood by way of the following examples.

Inventive Example 1

Samples were prepared by making catalysts adhere on the surface of each of substrates and electroless-plating the surface of the substrate in accordance with the following steps. In addition, a polycrystalline glass sheet, an epoxy substrate, a Si substrate on which a TiN film was formed, and a no-alkali glass sheet were used as the substrates for the following four kinds of electroless plating, respectively.

Catalyst Nuclei Formation and Plating Steps

A. Degreasing

The substrates were dipped in the following degreasing solution kept at 50° C. for 3 min.

B. Rinsing

25° C., 15 sec

C. Surface Preparation

The substrates were dipped in the following surface preparation solution kept at 30° C. for 5 min.

D. Rinsing

25° C., 15 sec

E. Sensitizing

The substrates were dipped in the following sensitizing solution kept at 20° C. for 1 min.

F. Rinsing

25° C., 15 sec

G. Catalyst Nuclei Formation (1)

The substrates were dipped in the following first activation solution containing a silver salt kept at 20° C. for 1 min.

H. Rinsing

25° C., 15 sec

The steps E to H were repeated by three times.

I. Catalyst Nuclei Formation (2)

The substrates were dipped in the following second activation solution containing palladium salt kept at 20° C. for 5 sec.

J. Rinsing

25° C., 15 sec

The steps I and J were repeated by two times.

K. Electroless Plating

The following four kinds of electroless plating were performed.

(a) Electroless Ni—P Plating:

The substrate (polycrystalline glass sheet) was dipped in the following electroless Ni—P plating solution having a pH of 4.6 kept at 90° C. for 1 min.

(b) Electroless Ni—B Plating:

The substrate (epoxy substrate) was dipped in the following electroless Ni—B plating solution having a pH of 6.6 kept at 65° C. for 1 min.

(c) Electroless Cu Plating:

The substrate (Si substrate on which the TiN film was formed as a barrier layer) was dipped in the following electroless Cu plating solution having a pH of 13 kept at 35° C. for 1 min.

(d) Electroless ZnO Plating:

The substrate (no-alkali glass sheet) was dipped in each of the following three kinds of electroless ZnO plating solution having a pH of 6.5 kept at 65° C. for 30 min.

The surface state of each of the samples thus obtained was observed by using an AFM (Atomic force Microscope). The sample having been subjected to electroless Ni—P plating (a) and the sample having been subjected to electroless Cu plating (c) were subjected to tape test for examining the adhesion between the electroless Ni—P plating film and the crystalline glass sheet and the adhesion between the electroless Cu plating film and the TiN film formed on the Si substrate, respectively.

| | |
|---|---|
| Degreasing Agent | |
| Asahi Cleaner C-4000 (produced by C. Uyemura Co., Ltd.) | 5 g/L |
| Surface Preparation Agent | |
| Through Cup CD-202 (produced by C. Uyemura Co., Ltd.) | 50 mL/L |
| Sensitizing Solution | |
| $SnCl_2.2H_2O$ | 15 g/L |
| HCl | 15 mL/L |
| First Activation Solution (Ag Salt) | |
| $AgNO_3$ | 1.5 g/L |
| $NiSO_4.6H_2$ 0 | 0.3 g/L |
| pH | 7 |
| Second Activation Solution (Pd Salt) | |
| $PdCl_2$ | 1 g/L |
| HCl | 1 mL/L |
| $Pb(NO_3)_2$ | 0.1 g/L |
| $Ag_2SO_4$ | 0.03 g/L |
| Borofluoric acid | 0.01 mL/L |
| pH | 1.5 |

Electroless Ni—P Plating Solution

Nimuden DX (reducing agent: sodium hypophosphite, produced by C. Uyemura Co., Ltd.)

| | |
|---|---|
| pH | 4.6 |
| Electroless Ni-B Plating Solution | |
| BEL 801 (reducing agent: dimethylamine-borane, produced by C. Uyemura Co., Ltd.) | |
| pH | 6.6 |
| Electroless Cu Plating Solution | |
| Through Cup PEA (reducing agent: formaldehyde, produced by C. Uyemura Co., Ltd.) | |
| pH | 13 |
| Electroless ZnO Plating Solution (1) | |
| $Zn(N0_3)_2$ | 0.1 mol/L |
| dimethylamine-borane | 0.03 mol/L |
| pH | 6.5 |
| Electroless ZnO Plating Solution (2) | |
| $Zn(N0_3)_2$ | 0.1 mol/L |
| dimethylamine-borane | 0.05 mol/L |
| pH | 6.5 |
| Electroless ZnO Plating Solution (3) | |
| $Zn(N0_3)_2$ | 0.1 mol/L |
| dimethylamine-borane | 0.1 mol/L |
| pH | 6.5 |

Comparative Example 1

The same procedure as that in Inventive Example 1 was repeated except that the catalyst nuclei formation treatment was performed only by using the first activator containing the silver salt.

Comparative Example 2

The same procedure as that in Inventive Example 1 was repeated except that the catalyst nuclei formation treatment was performed only by using the second activator containing the palladium salt.

The result of observing the adsorption state of catalyst particles on the epoxy substrate in each of Inventive Example 1 and Comparative Examples 1 and 2 by the AFM is shown in Table 1. The result of observing the initial deposition state of catalyst particles in each electroless plating by the AFM is shown in Table 2. The result of examining the presence/absence of peeling of the electroless Ni—P plating film from the polycrystalline glass sheet and peeling of the electroless Cu plating film from the TiN film on the Si substrate is shown in Table 3.

TABLE 1

| Catalyst nuclei formation | Nuclei density of catalysts (number/$m^2$) | Particle size of catalyst (nm) | Average surface roughness Rms (nm) |
|---|---|---|---|
| Inventive Example 1 (Sn—Ag—Pd) | 3000 | 0.5 | 0.1 |
| Comparative Example 1 (Sn—Ag) | 1200 | 15.8 | 1.5 |
| Comparative Example 2 (Sn—Pd) | 900 | 4.2 | 3.8 |

(substrate: epoxy substrate)

TABLE 2

| Catalyst nuclei formation | Plating solution | Nuclei density of initial catalyst (number/$m^2$) | Presence/absence of defect in initial precipitation layer |
|---|---|---|---|
| Inventive Example 1 (Sn—Ag—Pd) | Electroless Ni—P | 2000 | Absence |
| | Electroless Ni—B | 1500 | Absence |
| | Electroless Cu | 2500 | Absence |
| | Electroless ZnO (1) | 3000 | Absence |
| | Electroless ZnO (2) | 2500 | Absence |
| | Electroless ZnO (3) | 2000 | Absence |
| Comparative Example 1 (Sn—Ag) | Electroless Ni—P | Not precipitated | — |
| | Electroless Ni—B | Not precipitated | — |
| | Electroless Cu | 1000 | Presence |
| | Electroless ZnO (1) | 1500 | Presence |
| | Electroless ZnO (2) | 1000 | Presence |
| | Electroless ZnO (3) | 800 | Presence |
| Comparative Example 2 (Sn—Pd) | Electroless Ni—P | 800 | Presence |
| | Electroless Ni—B | 650 | Presence |
| | Electroless Cu | 700 | Presence |
| | Electroless ZnO (1) | 750 | Presence |
| | Electroless ZnO (2) | 600 | Presence |
| | Electroless ZnO (3) | 600 | Presence |

(substrate:
electroless Ni—P: polycrystalline glass
electroless Ni—B: epoxy substrate
electroless Cu: TiN film on Si substrate
electroless ZnO: no-alkali glass)

Note 1: The results were obtained when electroless ZnO film was deposited on soda lime glass.

Note 2: As a result of evaluating the external appearance of the electroless ZnO plating films, the film in Inventive Example 1 was transparent and colorless but the film in Comparative example 1 was transparent but was colored into yellow.

TABLE 3

| Catalytic nuclei formation | Plating solution | Adhesiveness to substrate |
|---|---|---|
| Inventive example 1 (Sn—Ag—Pd) | Electroless Ni—P | Good |
| | Electroless Cu | Good |
| Comparative Example 1 (Sn—Ag) | Electroless Ni—P | Poor |
| | Electroless Cu | Poor |
| Comparative example 2 (Sn—Pd) | Electroless Ni—P | Poor |
| | Electroless Cu | Poor |

From the results shown in Table 1, it is revealed that fine catalyst particles can be made to adhere on the non-conductive substrate at a high density according to the present invention.

From the results shown in Table 2, it is revealed that the electroless plating film without any defect found in an initial deposition layer can be formed on the non-conductive substrate according to the present invention.

From the results shown in Table 3, it is revealed that the electroless Ni—P plating film excellent in adhesion can be formed on the polycrystalline glass sheet, and the electroless Cu plating film excellent in adhesion can be formed on the TiN barrier film provided on the Si substrate.

Inventive Examples 2 and 3

Two samples were prepared by cleaning each of no-alkali glass sheets with the following degreasing agent, dipping the glass sheet in the following surface preparation solution kept at 45° C. for 5 min, rinsing the sheet, sensitizing the sheet by dipping it in the following sensitizing solution kept at 20°

C. for 1 min, activating the sheet by dipping it in the following palladium activation solution kept at 20° C. for 1 min, and by dipping the sheet in the following electroless ZnO plating solution kept at 65° C. for 2 hr, thereby depositing a zinc oxide layer on the glass sheet.

| | |
|---|---|
| Degreasing Agent | |
| Asahi Cleaner C-4000 (produced by C. Uyemura Co., Ltd.) | 5 g/L |
| Surface Preparation Agent Through Cup CD-202 (produced by C. Uyemura Co., Ltd.) | 50 mL/L |
| Sensitizing Solution | |
| S-10X (produced by C. Uyemura Co., Ltd.) | 100 mL/L |
| HC1 | 20 mL/L |
| Activation Solution (Pd) | |
| A-10X (produced by C. Uyemura Co., Ltd.) | 100 ml/L |
| Electroless ZnO Plating Solution | |
| $Zn(N0_3)_2$ | 30 g/L |
| dimethylamine-borane | 5 g/L |
| pH | 6.2 |

Threreafter, one of the samples thus prepared was heat-treated in a nitrogen atmosphere at 500° C. for 30 min (Inventive Example 2), and the other samples was heat-treated in an atmospheric air at 500° C. for 30 min (Inventive Example 3).

The thickness of the zinc oxide film of each sample thus heat-treated was 0.2 $\mu$m. The result of examining the light transmittance and resistivity of each of the zinc oxide films is shown in Table 4. In addition, the light transmittance was measured by an absorptiometry method, and the resistivity was measured by a four probe method of the resistivity measurement.

TABLE 4

| | Light transmittance (%) | Resistivity (Ω cm) |
|---|---|---|
| Inventive Example 2 | 85 | $1.9 \times 10^{-2}$ |
| Inventive Example 3 | 85 | $2.1 \times 10^{-2}$ |

From the results shown in Table 4, it is revealed that the zinc oxide film very excellent in transparency and electric conductivity can be formed on the substrate.

Inventive Examples 4, 5 and 6

Three samples were prepared by forming a zinc oxide film by the same procedure as in Inventive Example 1 using Electroless ZnO Plating Solution (1).

Thereafter, the sample was dipped in the following modifier kept at 30° C. for 10 sec, to obtain a zinc oxide film modified by a trivalent metal (Inventive Example 4: modification by In; Inventive Example 5: modification by Al; and Invention Example 6: modification by Ga).

Modifier for Zinc Oxide Film

| | |
|---|---|
| Inventive Example 4: In-based Modifier | |
| indium sulfate | 5 g/L |
| pH | 4 |
| Inventive Example 5: Al-based Modifier | |
| aluminum sulfate | 5 gL |
| pH | 4 |
| Inventive Example 6: Ga-based Modifier | |
| gallium sulfate | 5 g/L |
| pH | 3 |

These samples were then heat-treated in a nitrogen atmosphere at 550° C. for 30 min, to obtain modified zinc oxide films in Inventive examples 4, 5 and 6.

As a result of element analysis of the surface of each of the modified zinc oxide films by ESCA, it was confirmed that the surface of the modified zinc oxide film is covered with In, Al or Ga.

Comparative Example 3

A sample was prepared by forming an electroless ZnO film on a non-conductive substrate, and directly heat-treating, not by way of surface modification, the substrate in a nitrogen atmosphere at 550° C. for 30 min to form a zinc oxide film on the substrate.

The average visual light transmittance, the resistivity, and the variation in resistivity in an environmental test (240 hr) with a temperature of 60° C. and a humidity of 90% of each of the zinc oxide film modified by In obtained in Inventive Example 4 and the zinc oxide film obtained in Comparative Example 3 are shown in Table 5. In addition, the light transmittance was measured by the absorptiometry method, and the resistivity was measured by the four probe method of the resistivity measurement.

TABLE 5

| | Resistivity (Ω cm) | Variation rate of resistively after environmental test (%) | Light transmittance (%) |
|---|---|---|---|
| Inventive Example 4 | $4.51 \times 10^{-3}$ | 120 | 90 |
| Comparative Example 3 | $1.9 \times 10^{-2}$ | 14000 | 90 |

From the above result, it is revealed that the zinc oxide film modified by trivalent metal ions by using the modifier of the present invention can exhibit the stable surface state with less variation in resistivity.

While the preferred embodiment of the present invention will be described using specific terms, such description is for illustrative purposes only, and it is to be understood that changes and variations may be made without departing from the spirit or scope of the following claims.

What is claimed is:

1. A process for forming catalyst nuclei on a substrate, comprising the steps of:

preparing a substrate having a non-conductive portion to be electroless-plated;

sensitizing said non-conductive portion by dipping said substrate in a sensitizing solution containing bivalent tin ions;

activating said non-conductive portion by dipping said substrate in a first activator containing silver ions; and activating said non-conductive portion by dipping said substrate in a second activator containing palladium ions;

said sensitizing step and said activating step using said first activator containing silver ions are repeated by several times before said activating step using said second activator containing palladium ions;

whereby catalyst particles composed of silver nuclei and palladium nuclei each having an average particle size of 1 nm or less adsorb on said non-conductive portion at a nuclei density of 2000 nuclei/$\mu m^2$ or more.

2. The process of forming catalyst nuclei on a substrate according to claim 1, wherein said activating step using said first activator containing silver ions and said activating step using said second activator containing palladium ions are repeated by several times before electroless-plating.

3. A process of electroless-plating a substrate comprising:

preparing a substrate having a non-conductive portion to be electroless-plated;

sensitizing said non-conductive portion by dipping said substrate in a sensitizing solution containing bivalent tin ions;

activating said non-conductive portion by dipping said substrate in a first activator containing silver ions;

activating said non-conductive portion by dipping said substrate in a second activator containing palladium ions; and electroless-plating said non-conductive portion thus activated by dipping said substrate in an electroless plating solution;

said sensitizing step and said activating step using said first activator containing silver ions are repeated by several times before said activating step using said second activator containing palladium ions;

wherein catalyst particles composed of silver nuclei and palladium nuclei each having an average particle size of 1 nm or less, at both said activating steps, adsorb on said non-conductive portion at a nuclei density of 2000 nuclei/$\mu m^2$ or more.

4. A process of electroless-plating a substrate according to claim 3, wherein said electroless plating solution is selected from the group consisting of an electroless nickel plating solution, an electroless copper plating solution, and an electroless zinc oxide plating solution.

5. A process of electroless-plating a substrate according to claim 3, wherein said substrate is a silicon substrate on the surface of which either of a Ta film, a TaN film and a TiN film is formed, and said electroless plating solution is the electroless copper plating solution.

6. A process of electroless-plating a substrate according to claim 3, wherein said substrate is a printed wiring board having a through-hole, a peripheral wall portion of which is taken as said non-conductive portion to be electroless-plated, and said electroless plating solution is the electroless copper plating solution.

7. A process of electroless-plating a substrate according to claim 3, wherein said substrate is a polycrystalline glass substrate, and said electroless plating solution is the electroless nickel plating solution.

8. A process of electroless-plating a substrate according to claim 3, wherein said substrate is a transparent substrate, and said electroless plating solution is the electroless zinc oxide plating solution.

9. The process of electroless-plating a substrate according to claim 3, wherein said activating step using said first activator containing silver ions and said activating step using said second activator containing palladium ions are repeated by several times before said electroless-plating step.

10. A process of producing a modified zinc oxide film, comprising the steps of:

preparing a transparent substrate having a non-conductive portion to be electroless-plated;

sensitizing said non-conductive portion by dipping said substrate in a sensitizing solution containing bivalent tin ions;

activating said non-conductive portion by dipping said substrate in a first activator containing silver ions;

activating said non-conductive portion by dipping said substrate in a second activator containing palladium ions;

electroless-plating said non-conductive portion thus activated by dipping said substrate in an electroless zinc oxide plating solution, to form a zinc oxide film;

treating said zinc oxide film with a modifier composed of a water solution containing trivalent cations; and heating said zinc oxide film thus treated;

wherein catalyst particles composed of silver nuclei and palladium nuclei each having an average particle size of 1 nm or less, at both said activating steps, adsorb on said non-conductive portion at a nuclei density of 2000 nuclei/$\mu m^2$ or more.

11. A process of producing a modified zinc oxide film according to claim 10, wherein said heating step is performed at a heating temperature ranging from 150° C. to 700° C.

12. A process of producing a modified zinc oxide film according to claim 10, wherein said heating step is performed in a heating atmosphere selected from air, a non-oxidizing gas atmosphere, and a mixed gas atmosphere thereof.

* * * * *